US008740649B2

(12) United States Patent
Lan et al.

(10) Patent No.: US 8,740,649 B2
(45) Date of Patent: Jun. 3, 2014

(54) ELECTRICAL CONNECTOR

(75) Inventors: Rong-Qin Lan, Guang-Dong (CN); Li-Jun Xu, Guang-Dong (CN); Ming-Han Lin, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/562,251

(22) Filed: Jul. 30, 2012

(65) Prior Publication Data

US 2014/0030920 A1 Jan. 30, 2014

(51) Int. Cl.
*H01R 13/648* (2006.01)
*H01R 12/16* (2006.01)
*H01R 13/506* (2006.01)

(52) U.S. Cl.
CPC ..... *H01R 23/7073* (2013.01); *H01R 13/506* (2013.01); *Y10S 439/904* (2013.01)
USPC ..... 439/607.4; 439/660; 439/904

(58) Field of Classification Search
USPC ..... 439/607.01, 79, 66, 660, 607.35, 439/607.36, 701
See application file for complete search history.

(56) References Cited

U.S. PATENT DOCUMENTS 6,095,865 A * 8/2000 Wu ..... 439/607.01
6,736,651 B2 * 5/2004 Ho ..... 439/79
6,863,549 B2 * 3/2005 Brunker et al. ..... 439/108
7,025,632 B2 * 4/2006 Hu et al. ..... 439/606
7,217,159 B2 * 5/2007 Chung ..... 439/607.01
7,722,407 B2 * 5/2010 Momose ..... 439/638
7,748,999 B1 * 7/2010 Sun et al. ..... 439/79
7,883,369 B1 * 2/2011 Sun et al. ..... 439/607.35
8,398,439 B1 * 3/2013 Wang ..... 439/660
2010/0167594 A1 * 7/2010 Lee et al. ..... 439/660
2012/0009823 A1 * 1/2012 Lapidot et al. ..... 439/626
2012/0071027 A1 * 3/2012 Yu ..... 439/607.4

* cited by examiner

*Primary Examiner* — Neil Abrams
*Assistant Examiner* — Travis Chambers
(74) *Attorney, Agent, or Firm* — Cheng-Ju Chiang

(57) ABSTRACT

An electrical connector adapted for being soldered to a circuit board includes an insulating housing, a shielding shell enclosing the insulating housing, a first terminal pack and a second terminal pack. The first terminal pack includes a first main body, and a plurality of first terminals molded to the first main body. The second terminal pack includes a second main body, and a plurality of second terminals molded to the second main body. The first terminal pack is engaged with the second terminal pack with first soldering portions of the first terminals and second soldering portions of the second terminals being alternately aligned in line to make all of the soldering portions show a single-row arrangement for being soldered with the circuit board. The first and second terminal packs are assembled to the insulating housing together with the shielding shell.

12 Claims, 4 Drawing Sheets

ELECTRICAL CONNECTOR

BACKGROUND OF THE INVENTION

1. Field of the Invention

The present invention generally relates to an electrical connector, and more particularly to an electrical connector capable of being soldered to a circuit board.

2. The Related Art

Conventionally, an electrical connector adapted for being soldered to a circuit board includes an insulating housing, a terminal assembly and a shielding shell. The insulating housing has a locating portion, and a tongue portion protruding forward from a front of the locating portion. The insulating housing defines a plurality of first terminal grooves of which each penetrates through a top surface of the tongue portion and an upper portion of the locating portion, and a plurality of second terminal grooves of which each penetrates through a bottom surface of the tongue portion and a lower portion of the locating portion. The terminal assembly includes a plurality of first terminals integrally molded to the first terminal grooves of the insulating housing, and a plurality of second terminals integrally molded to the second terminal grooves of the insulating housing. Each of the first terminals has a first soldering portion projecting behind the locating portion through the upper portion of the locating portion. Each of the second terminals has a second soldering portion projecting behind the locating portion through the lower portion of the locating portion and being located under the first soldering portion of the first terminal. The shielding shell encloses the insulating housing together with the terminal assembly.

However, the first soldering portions of the first terminals and the second soldering portions of the second terminals project behind the locating portion respectively through the upper portion and the lower portion of the locating portion, and are arranged in a manner of double-row arrangement. As a result, it often affects the process of soldering the electrical connector to the circuit board, and even affects a wiring arrangement of the circuit board.

SUMMARY OF THE INVENTION

An object of the present invention is to provide an electrical connector adapted for being soldered to a circuit board. The electrical connector includes an insulating housing, a shielding shell, a first terminal pack and a second terminal pack. The insulating housing has a base frame which has a front wall, a top wall extending rearward from a top of the front wall, a bottom wall extending rearward from a bottom of the front wall, and two side walls respectively connecting between the top wall and the bottom wall. An inserting space is formed among the front wall, the top wall, the bottom wall and the two side walls. A substantial middle of the front wall protrudes forward to form a tongue portion. The insulating housing defines a plurality of first terminal grooves of which each penetrates through a top surface of the tongue portion and an upper portion of the front wall, and a plurality of second terminal grooves of which each penetrates through a bottom surface of the tongue portion and a lower portion of the front wall. The shielding shell encloses the insulating housing. The first terminal pack includes a first main body, and a plurality of first terminals molded to the first main body. Each of the first terminals has a first contact portion projecting beyond a front of the first main body, and a first soldering portion projecting behind a rear of the first main body. The second terminal pack includes a second main body, and a plurality of second terminals molded to the second main body. Each of the second terminals has a second contact portion projecting beyond a front of the second main body, and a second soldering portion projecting behind a rear of the second main body. The first terminal pack is engaged with the second terminal pack with the first soldering portions of the first terminals and the second soldering portions of the second terminals being alternately aligned in line to make all of the soldering portions show a single-row arrangement for being soldered with the circuit board. The first terminal pack and the second terminal pack are assembled to the insulating housing together with the shielding shell with the first main body and the second main body partially inserted in the inserting space of the insulating housing, the first contact portions of the first terminals being inserted into the first terminal grooves of the insulating housing through the inserting space of the insulating housing and the second contact portions of the second terminals being inserted into the second terminal grooves of the insulating housing through the inserting space of the insulating housing.

As described above, the first terminal pack is engaged with the second terminal pack with the first soldering portions of the first terminals and the second soldering portions of the second terminals alternately aligned in line to make all of the soldering portions show the single-row arrangement. So, it brings convenience to the process of soldering the electrical connector to the circuit board, and further brings advantage to a wiring arrangement of the circuit board. Furthermore, when a defect of soldering the electrical connector to the circuit board happens, it's convenient for operating a repair soldering action between the electrical connector and the circuit board.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
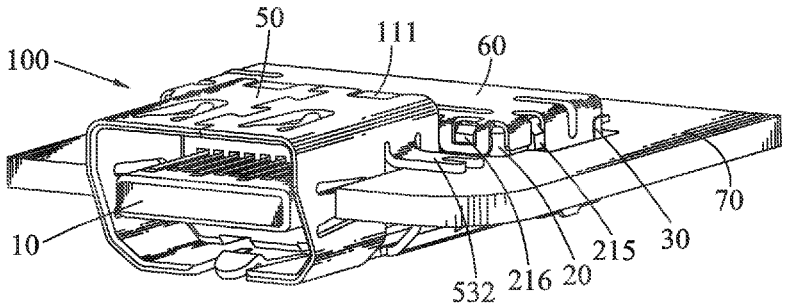
FIG. 1 is a perspective view of an electrical connector in accordance with the present invention, wherein the electrical connector is soldered to a circuit board.
Figure 2:
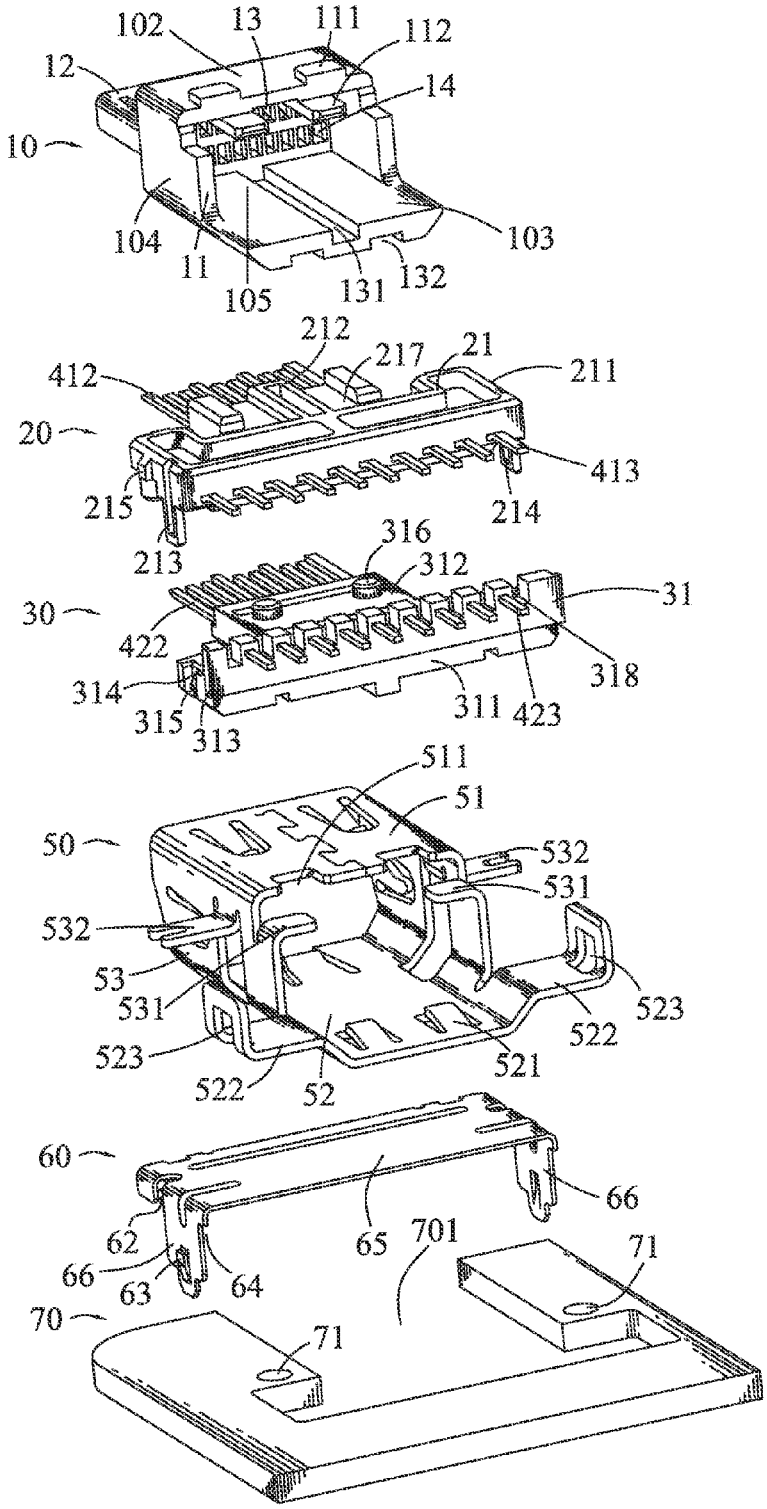
FIG. 2 is an exploded view of the electrical connector of FIG. 1, wherein the electrical connector is apart from the circuit board.
Figure 3:
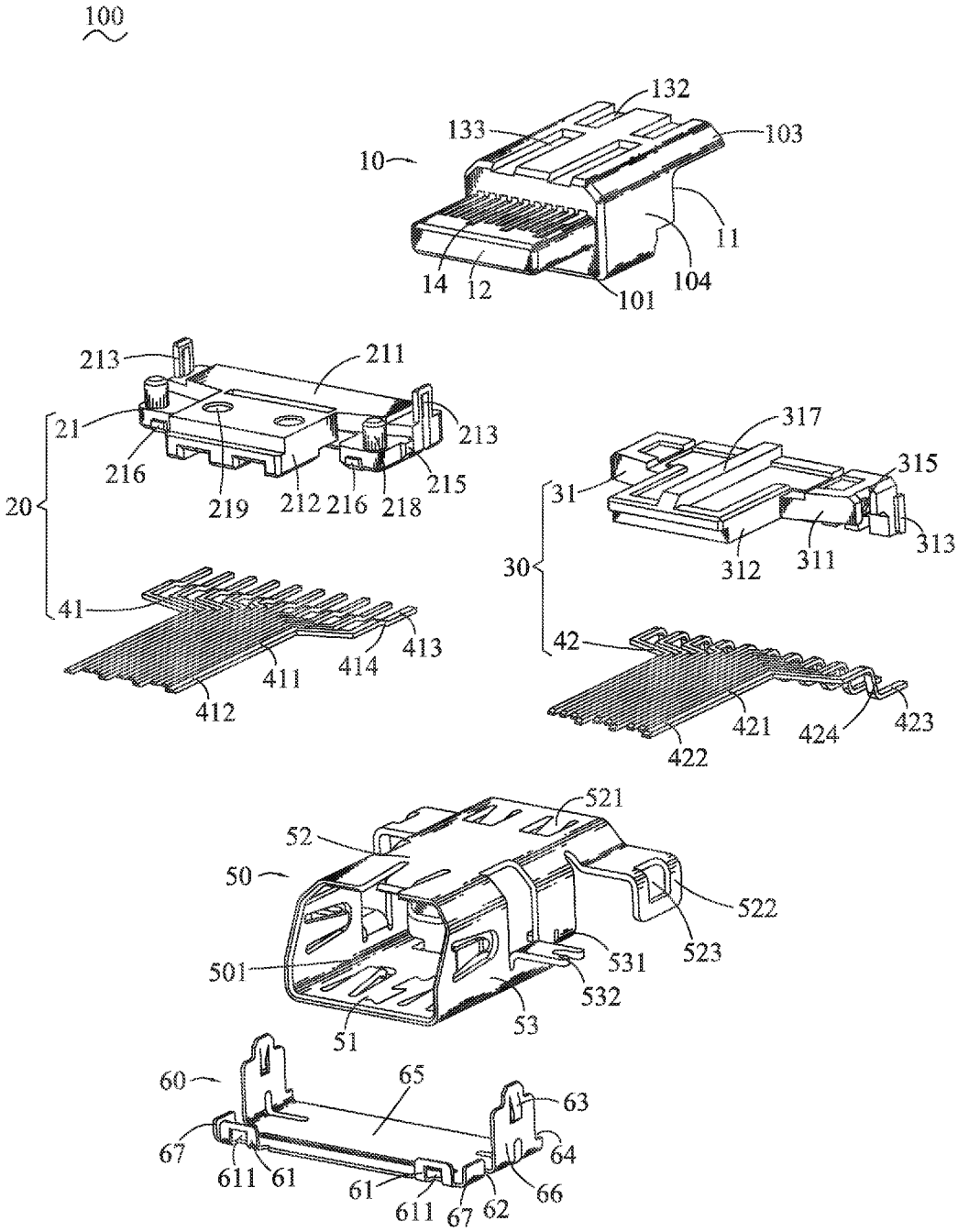
FIG. 3 is another exploded view of the electrical connector of FIG. 1.
Figure 4:
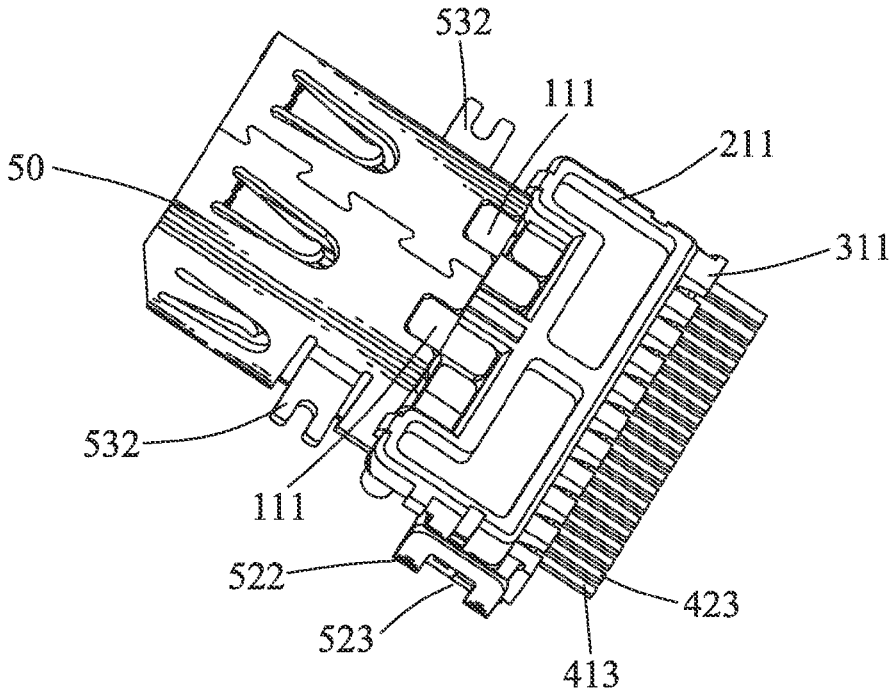
FIG. 4 is a partially perspective view of the electrical connector of FIG. 1, wherein a first terminal pack and a second terminal pack of the electrical connector are assembled to an insulating housing of the electrical connector together with a shielding shell of the electrical connector.

With reference to FIG. 1, FIG. 2 and FIG. 3, an electrical connector 100 in accordance with the present invention is shown. The electrical connector 100 adapted for being soldered to a circuit board 70 includes an insulating housing 10, a shielding shell 50, a first terminal pack 20, a second terminal pack 30 and a cover 60.

Referring to FIG. 2 and FIG. 3, the insulating housing 10 has a base frame 11. The base frame 11 has a front wall 101, a top wall 102 extending rearward from a top of the front wall 101, a bottom wall 103 extending rearward from a bottom of the front wall 101 and longer than the top wall 102, and two side walls 104 respectively connecting between the top wall 102 and a front of the bottom wall 103. An inserting space 105 is formed among the front wall 101, the top wall 102, the bottom wall 103 and the two side walls 104. Two portions of a rear of a top surface of the top wall 102 protrude upward to form two restricting blocks 111 spaced from each other. Two portions of a bottom surface of the top wall 102 protrude downward and then extend rearward to project beyond a rear surface of the top wall 102 to form two first guiding blocks 112 spaced from each other and respectively apart from the two side walls 104. A substantial middle of the front wall 101 protrudes forward to form a tongue portion 12. The insulating housing 10 defines a plurality of first terminal grooves 13 of which each penetrates through a top surface of the tongue portion 12 and an upper portion of the front wall 101, and a plurality of second terminal grooves 14 of which each penetrates through a bottom surface of the tongue portion 12 and a lower portion of the front wall 101. A middle of a top surface of the bottom wall 103 is concaved downward to form a first guiding groove 131 extending longitudinally to pass through a rear surface of the bottom wall 103. Two rears of two opposite sides of a bottom surface of the bottom wall 103 are recessed inward to form two buckling grooves 132. Two fronts of the two opposite sides of the bottom surface of the bottom wall 103 are recessed inward to form two leading grooves 133 passing through the front wall 101 of the base frame 11 and respectively in alignment with the two buckling grooves 132.

Referring to FIG. 2 and FIG. 3, the shielding shell 50 has a bottom plate 52, two lateral plates 53 extending upward from two fronts of two opposite sides of the bottom plate 52, and a top plate 51 connecting with two top edges of the two lateral plates 53. An accommodating space 501 is formed among the bottom plate 52, the two lateral plates 53 and the top plate 51. Two opposite sides of a rear edge of the top plate 51 are recessed inward to form two restricting grooves 511. Two opposite sides of a rear of the bottom plate 52 are punched inward to form two buckling pieces 521. Two rears of the two opposite sides of the bottom plate 52 are inclined oppositely, then extend oppositely and further extend upward to form two flanks 522. A right-angle junction of each flank 522 is cut off to define a buckling hole 523. Two bottoms of two rears of the two lateral plates 53 extend rearward and then extend upward to form two clamping pieces 531 of which two tops are spaced from the rears of the corresponding lateral plates 53. Two middles of the two lateral plates 53 are punched oppositely and horizontally to form two soldering arms 532.

Referring to FIG. 2 and FIG. 3, the first terminal pack 20 includes a first main body 21 and a plurality of first terminals 41 molded to the first main body 21. The second terminal pack 30 includes a second main body 31 and a plurality of second terminals 42 integrally molded to the second main body 31.

Referring to FIG. 2 and FIG. 3, the first main body 21 of the first terminal pack 20 has a rectangular first locating portion 211. Two rears of two opposite sides of the first locating portion 211 extend downward to form two buckling arms 213. Two facing inner surfaces of the two buckling arms 213 are concaved oppositely to form two fixing grooves 214. Two substantial middles of the two opposite sides of the first locating portion 211 protrude oppositely to form two first fastening blocks 215. Two opposite sides of a front of the first locating portion 211 protrude forward to form two second fastening blocks 216. Two opposite sides of a bottom of the first locating portion 211 protrude downward to form two first locating pillars 218. A middle of the front of the first locating portion 211 protrudes forward to form a first protruding portion 212 located between the two second fastening blocks 216 and between the two first locating pillars 218. Two opposite sides of a top face of the first protruding portion 212 are concaved downward to form two second guiding grooves 217 spaced from each other and passing through a front face of the first protruding portion 212. Two opposite sides of a bottom face of the first protruding portion 212 of the first main body 21 are recessed inward to form two inserting holes 219.

Referring to FIG. 2 and FIG. 3, the second main body 31 of the second terminal pack 30 has a step-shaped second locating portion 311, and a second protruding portion 312 protruding forward from a middle of a front of a lower step of the second locating portion 311. Two rears of two opposite sides of the second locating portion 311 protrude oppositely to form two blocking blocks 313. Two fronts of the two opposite sides of the second locating portion 311 are concaved inward to form two openings 314. Two opposite inner sidewalls of the two openings 314 protrude oppositely to form two fixing lumps 315. Two opposite sides of a top face of the second protruding portion 312 protrude upward to form two second locating pillars 316. A middle of a bottom surface of the second main body 31 protrudes downward to form a second guiding block 317 extending longitudinally. A plurality of channels 318 is respectively concaved downward in a top of an upper step of the second locating portion 311 and extends longitudinally to penetrate through a front and a rear of the top of the upper step of the second locating portion 311.

Referring to FIG. 2 and FIG. 3, each of the first terminals 41 is stamped from a metal plate, and has a first base portion 411 molded to the first main body 21, a first connecting portion 414 molded to the first main body 21, a first contact portion 412 projecting beyond a front of the first main body 21, and a first soldering portion 413 projecting behind a rear of the first main body 21. The first base portion 411 of one of the first terminals 41 which is substantially disposed in the middle of the first terminals 41 is of an elongated straight strip shape. The first base portions 411 of the other first terminals 41 have fronts thereof parallel to the middle first base portion 411 and rears thereof curved sideward away from the middle first base portion 411 and then extending rearward. A front end of each first base portion 411 extends forward to form the first contact portion 412. A rear end of each first base portion 411 is inclined upward to form the first connecting portion 414. A rear end of each first connecting portion 414 extends rearward to form the first soldering portion 413.

Referring to FIG. 2 and FIG. 3, each of the second terminals 42 is stamped from the metal plate, and has a second base portion 421 molded to the second main body 31, a second connecting portion 424 molded to the second main body 31, a second contact portion 422 projecting beyond a front of the second main body 31, and a second soldering portion 423 projecting behind a rear of the second main body 31 and alternating with the channels 318 of the second main body 31. The second base portion 421 of one of the second terminals 42 which is substantially disposed in the middle of the second terminals 42 is of an elongated straight strip shape. The second base portions 421 of the other second terminals 42 have fronts thereof parallel to the middle second base portion 421, and rears thereof curved sideward away from the middle second base portion 421 and then extending rearward. A front end of each second base portion 421 extends forward to form the second contact portion 422. A rear end of each second base portion 421 is bent upward to form the second connecting portion 424. A rear end of each second connecting portion 424 extends rearward to form the second soldering portion 423.

Referring to FIG. 2 and FIG. 3, the cover 60 has a flat plate 65. Two opposite sides of a front edge of the flat plate 65 are bent downward to form two fastening portions 61 with two fastening holes 611 being formed therein. Two rears of two opposite sides of the flat plate 65 are bent downward to form two blocking plates 66. Two rear edges of the two blocking plates 66 are recessed forward to form two blocking gaps 64. The two blocking plates 66 are punched oppositely to form two buckling portions 63. Two fronts of the two opposite sides of the flat plate 65 are bent downward to form two bending arms 67 of which each is spaced from the corresponding blocking plate 66 to form a notch 62 between each bending arm 67 and the corresponding blocking plate 66. A middle of a front of the circuit board 70 is cut off to define a T-shaped assembling groove 701 with a rear thereof being wider than a front thereof. Two tops of two opposite sidewalls of the assembling groove 701 of the circuit board 70 define two locating holes 71 matched with the first locating pillars 218 of the first terminal pack 20.

Referring to FIGS. 1-4, when the electrical connector 100 is assembled, at first, the first terminal pack 20 is engaged with the second terminal pack 30. A bottom of the first protruding portion 212 of the first main body 21 of the first terminal pack 20 is positioned on the top face of the second protruding portion 312 of the second main body 31 of the second terminal pack 30, and a bottom of the first locating portion 211 of the first main body 21 of the first terminal pack 20 is partially positioned on a top face of the lower step of the second locating portion 311 of the second main body 31 of the second terminal pack 30. The two second locating pillars 316 of the second main body 31 are inserted into the two inserting holes 219 of the first main body 21, the rear of the first locating portion 211 of the first main body 21 abuts against a front of the upper step of the second locating portion 311 of the second main body 31, and the buckling arms 213 of the first main body 21 are received in the openings 314 of the second main body 31 for fastening the two fixing lumps 315 of the second main body 31 in the fixing grooves 214 of the first main body 21 so as to integrate the first main body 21 and the second main body 31 tightly. The first soldering portions 413 of the first terminals 41 pass through the channels 318 of the second main body 31 to be alternately aligned with the second soldering portions 423 of the second terminals 42 in line so as to make all of the soldering portions 413, 423 show a single-row arrangement. The insulating housing 10 is assembled forward into the accommodating space 501 of the shielding shell 50. The first restricting blocks 111 are restricted in the restricting grooves 511 and the two buckling pieces 521 are buckled in the buckling grooves 132 along the leading grooves 133, so that make the insulating housing 10 and the shielding shell 50 fastened together tightly.

Then the first terminal pack 20 and the second terminal pack 30 are assembled forward to the insulating housing 10 together with the shielding shell 50. The first contact portions 412 of the first terminals 41 are inserted into the first terminal grooves 13 of the insulating housing 10 through the inserting space 105 of the insulating housing 10 and the second contact portions 422 of the second terminals 42 are inserted into the second terminal grooves 14 of the insulating housing 10 through the inserting space 105 of the insulating housing 10. The first protruding portion 212 of the first main body 21 of the first terminal pack 20 and the second protruding portion 312 of the second main body 31 of the second terminal pack 30 are partially inserted in the inserting space 105 of the insulating housing 10 by the guidance of the first guiding blocks 112 of the insulating housing 10 sliding into the second guiding grooves 217 of the first terminal pack 20 and the second guiding block 317 of the second terminal pack 30 sliding into the first guiding groove 131 of the insulating housing 10. After the above-mentioned actions, the two tops of the two clamping pieces 531 of the shielding shell 50 are bent face to face to press on two opposite sides of a rear of the first protruding portion 212 of the first terminal pack 20 so as to fasten the first terminal pack 20 and the second terminal pack 30 to the insulating housing 10 together with the shielding shell 50 firmly.

Again, the flat plate 65 of the cover 60 is covered on a top of a rear of the first main body 21 of the first terminal pack 20. The two buckling portions 63 of the cover 60 are buckled in the buckling holes 523 of the shielding shell 50. The second fastening blocks 216 of the first terminal pack 20 are fastened to the fastening holes 611 of the fastening portions 61 of the cover 60. The two first fastening blocks 215 of the first terminal pack 20 are clamped in the notches 62 of the cover 60. The two bending arms 67 of the cover 60 abut against two fronts of the two opposite sides of the first locating portion 211 of the first terminal pack 20. And the two blocking plates 66 of the cover 60 abut against the two opposite sides of the second locating portion 311 of the second terminal pack 30 with the two blocking blocks 313 of the second terminal pack 30 abutting against the two blocking gaps 64 of the cover 60. So that the cover 60, the shielding shell 50, the first terminal pack 20, the second terminal pack 30 and the insulating housing 10 are integrated tightly.

At last, when the electrical connector 100 is soldered to the circuit board 70, the first locating pillars 218 of the first terminal pack 20 are located in the locating holes 71 of the circuit board 70 for locating the electrical connector 100 to the circuit board 70 firmly. The soldering arms 532 of the shielding shell 50, the first soldering portions 413 of the first terminals 41, and the second soldering portions 423 of the second terminals 42 are soldered with the circuit board 70 so as to solder the electrical connector 100 to the circuit board 70 firmly.

As described above, the first terminal pack 20 is engaged with the second terminal pack 30 with the first soldering portions 413 of the first terminals 41 and the second soldering portions 423 of the second terminals 42 alternately aligned in line to make all of the soldering portions 413, 423 show the single-row arrangement. So, it brings convenience to the process of soldering the electrical connector 100 to the circuit board 70, and further brings advantage to a wiring arrangement of the circuit board 70. Furthermore, when a defect of soldering the electrical connector 100 to the circuit board 70 happens, it's convenient for operating a repair soldering action between the electrical connector 100 and the circuit board 70.

What is claimed is:

1. An electrical connector adapted for being soldered to a circuit board, comprising:

an insulating housing having a base frame which has a front wall, a top wall extending rearward from a top of the front wall, a bottom wall extending rearward from a bottom of the front wall, and two side walls respectively connecting between the top wall and the bottom wall, an inserting space being formed among the front wall, the top wall, the bottom wall and the two side walls, a substantial middle of the front wall protruding forward to form a tongue portion, the insulating housing defining a plurality of first terminal grooves of which each penetrates through a top surface of the tongue portion and an upper portion of the front wall, and a plurality of second terminal grooves of which each penetrates through a bottom surface of the tongue portion and a lower portion of the front wall;

a shielding shell enclosing the insulating housing;

a first terminal pack including a first main body, and a plurality of first terminals molded to the first main body, each of the first terminals having a first contact portion projecting beyond a front of the first main body, and a first soldering portion projecting behind a rear of the first main body; and a second terminal pack including a second main body, and a plurality of second terminals molded to the second main body, each of the second terminals having a second contact portion projecting beyond a front of the second main body, and a second soldering portion projecting behind a rear of the second main body;

wherein the first terminal pack is engaged with the second terminal pack with the first soldering portions of the first terminals and the second soldering portions of the second terminals being alternately aligned in line to make all of the soldering portions show a single-row arrangement for being soldered with the circuit board, the first terminal pack and the second terminal pack are assembled to the insulating housing together with the shielding shell with the first main body and the second main body partially inserted in the inserting space of the insulating housing, the first contact portions of the first terminals being inserted into the first terminal grooves of the insulating housing through the inserting space of the insulating housing and the second contact portions of the second terminals being inserted into the second terminal grooves of the insulating housing through the inserting space of the insulating housing; the first main body of the first terminal pack has a first locating portion, and a first protruding portion protruding forward from a middle of a front of the first locating portion, the second main body of the second terminal pack has a step-shaped second locating portion, and a second protruding portion protruding forward from a middle of a front of a lower step of the second locating portion, a bottom of the first protruding portion of the first main body is positioned on a top face of the second protruding portion of the second main body, and a bottom of the first locating portion of the first main body is partially positioned on a top face of the lower step of the second locating portion of the second main body with a rear of the first locating portion of the first main body abutting against a front of an upper step of the second locating portion of the second main body; a plurality of channels is respectively concaved downward in a top of the upper step of the second locating portion and extends longitudinally to penetrate through a front and a rear of the top of the upper step of the second locating portion, the second soldering portions of the second terminals alternate with the channels of the second main body, the first soldering portions of the first terminals pass through the channels of the second main body to be alternately aligned with the second soldering portions of the second terminals in line so as to make all of the soldering portions show the single-row arrangement.

2. The electrical connector as claimed in claim 1, wherein two opposite sides of a bottom face of the first protruding portion of the first main body are recessed inward to form two inserting holes, two opposite sides of the top face of the second protruding portion of the second main body protrude upward to form two second locating pillars inserted into the two inserting holes of the first protruding portion of the first main body.

3. The electrical connector as claimed in claim 1, wherein two rears of two opposite sides of the first locating portion of the first main body extend downward to form two buckling arms of which two facing inner surfaces are concaved oppositely to form two fixing grooves, two fronts of two opposite sides of the second locating portion of the second main body are concaved inward to form two openings of which two opposite inner sidewalls protrude oppositely to form two fixing lumps, the buckling arms are received in the openings for fastening the two fixing lumps in the fixing grooves.

4. The electrical connector as claimed in claim 1, wherein two portions of a bottom surface of the top wall of the insulating housing protrude downward to form two first guiding blocks, a middle of a top surface of the bottom wall of the insulating housing is concaved downward to form a first guiding groove extending longitudinally to pass through a rear surface of the bottom wall, two opposite sides of a top face of the first protruding portion are concaved downward to form two second guiding grooves passing through a front face of the first protruding portion, a middle of a bottom surface of the second main body protrudes downward to form a second guiding block, the first protruding portion of the first main body and the second protruding portion of the second main body are partially inserted into the inserting space of the insulating housing by the guidance of the first guiding blocks sliding into the second guiding grooves and the second guiding block sliding into the first guiding groove.

5. The electrical connector as claimed in claim 1, wherein two portions of a rear of a top surface of the top wall of the insulating housing protrude upward to form two restricting blocks, two rears of two opposite sides of a bottom surface of the bottom wall of the insulating housing are recessed inward to form two buckling grooves, the shielding shell has a top plate of which two opposite sides of a rear edge are recessed inward to form two restricting grooves for restricting the restricting blocks therein, a bottom plate of which two opposite sides of a rear are punched inward to form two buckling pieces buckled in the buckling grooves, and two lateral plates of which two bottoms of two rears extend rearward and then extend upward to form two clamping pieces, two tops of the two clamping pieces bend face to face for pressing on two opposite sides of a rear of the first protruding portion of the first terminal pack.

6. The electrical connector as claimed in claim 1, wherein two opposite sides of a bottom of the first locating portion protrude downward to form two first locating pillars, the circuit board defines two locating holes for locating the first locating pillars therein.

7. The electrical connector as claimed in claim 1, wherein the shielding shell has two lateral plates punched oppositely and horizontally to form two soldering arms soldered with the circuit board.

8. The electrical connector as claimed in claim 1, further comprising a cover which has a flat plate, two opposite sides of a front edge of the flat plate are bent downward to form two fastening portions with two fastening holes being formed therein, two rears of two opposite sides of the flat plate are bent downward to form two blocking plates, two fronts of the two opposite sides of the flat plate are bent downward to form two bending arms of which each is spaced from the corresponding blocking plate to form a notch between each bending arm and the corresponding blocking plate, two substantial middles of the two opposite sides of the first locating portion protrude oppositely to form two first fastening blocks clamped in the notches, two opposite sides of a front of the first locating portion protrude forward to form two second fastening blocks fastened to the fastening holes.

9. The electrical connector as claimed in claim 8, wherein two rear edges of the two blocking plates of the cover are recessed forward to form two blocking gaps, two rears of two opposite sides of the second locating portion protrude oppositely to form two blocking blocks abutting against the two blocking gaps of the cover.

10. The electrical connector as claimed in claim 8, wherein two rears of two opposite sides of the flat plate of the cover are bent downward to form two blocking plates which are punched oppositely to form two buckling portions, the shielding shell has a bottom plate of which two rears of two opposite sides are inclined oppositely, then extend oppositely and further bend upward to form two flanks, each of the flanks defines a buckling hole for buckling the buckling portion therein.

11. An electrical connector adapted for being soldered to a circuit board, comprising:

an insulating housing having a base frame which has a front wall, a top wall extending rearward from a top of the front wall, a bottom wall extending rearward from a bottom of the front wall, and two side walls respectively connecting between the top wall and the bottom wall, an inserting space being formed among the front wall, the top wall, the bottom wall and the two side walls, a substantial middle of the front wall protruding forward to form a tongue portion, the insulating housing defining a plurality of first terminal grooves of which each penetrates through a top surface of the tongue portion and an upper portion of the front wall, and a plurality of second terminal grooves of which each penetrates through a bottom surface of the tongue portion and a lower portion of the front wall;

a shielding shell enclosing the insulating housing;

a first terminal pack including a first main body, and a plurality of first terminals molded to the first main body, each of the first terminals having a first contact portion projecting beyond a front of the first main body, and a first soldering portion projecting behind a rear of the first main body; and a second terminal pack including a second main body, and a plurality of second terminals molded to the second main body, each of the second terminals having a second contact portion projecting beyond a front of the second main body, and a second soldering portion projecting behind a rear of the second main body;

wherein the first terminal pack is engaged with the second terminal pack with the first soldering portions of the first terminals and the second soldering portions of the second terminals being alternately aligned in line to make all of the soldering portions show a single-row arrangement for being soldered with the circuit board, the first terminal pack and the second terminal pack are assembled to the insulating housing together with the shielding shell with the first main body and the second main body partially inserted in the inserting space of the insulating housing, the first contact portions of the first terminals being inserted into the first terminal grooves of the insulating housing through the inserting space of the insulating housing and the second contact portions of the second terminals being inserted into the second terminal grooves of the insulating housing through the inserting space of the insulating housing; the first main body of the first terminal pack has a first locating portion, and a first protruding portion protruding forward from a middle of a front of the first locating portion, the second main body of the second terminal pack has a step-shaped second locating portion, and a second protruding portion protruding forward from a middle of a front of a lower step of the second locating portion, a bottom of the first protruding portion of the first main body is positioned on a top face of the second protruding portion of the second main body, and a bottom of the first locating portion of the first main body is partially positioned on a top face of the lower step of the second locating portion of the second main body with a rear of the first locating portion of the first main body abutting against a front of an upper step of the second locating portion of the second main body; two portions of a bottom surface of the top wall of the insulating housing protrude downward to form two first guiding blocks, a middle of a top surface of the bottom wall of the insulating housing is concaved downward to form a first guiding groove extending longitudinally to pass through a rear surface of the bottom wall, two opposite sides of a top face of the first protruding portion are concaved downward to form two second guiding grooves passing through a front face of the first protruding portion, a middle of a bottom surface of the second main body protrudes downward to form a second guiding block, the first protruding portion of the first main body and the second protruding portion of the second main body are partially inserted into the inserting space of the insulating housing by the guidance of the first guiding blocks sliding into the second guiding grooves and the second guiding block sliding into the first guiding groove.

12. An electrical connector adapted for being soldered to a circuit board, comprising:

an insulating housing having a base frame which has a front wall, a top wall extending rearward from a top of the front wall, a bottom wall extending rearward from a bottom of the front wall, and two side walls respectively connecting between the top wall and the bottom wall, an inserting space being formed among the front wall, the top wall, the bottom wall and the two side walls, a substantial middle of the front wall protruding forward to form a tongue portion, the insulating housing defining a plurality of first terminal grooves of which each penetrates through a top surface of the tongue portion and an upper portion of the front wall, and a plurality of second terminal grooves of which each penetrates through a bottom surface of the tongue portion and a lower portion of the front wall;

a shielding shell enclosing the insulating housing;

a first terminal pack including a first main body, and a plurality of first terminals molded to the first main body, each of the first terminals having a first contact portion projecting beyond a front of the first main body, and a first soldering portion projecting behind a rear of the first main body; and a second terminal pack including a second main body, and a plurality of second terminals molded to the second main body, each of the second terminals having a second contact portion projecting beyond a front of the second main body, and a second soldering portion projecting behind a rear of the second main body;

wherein the first terminal pack is engaged with the second terminal pack with the first soldering portions of the first terminals and the second soldering portions of the second terminals being alternately aligned in line to make all of the soldering portions show a single-row arrangement for being soldered with the circuit board, the first terminal pack and the second terminal pack are assembled to the insulating housing together with the shielding shell with the first main body and the second main body partially inserted in the inserting space of the insulating housing, the first contact portions of the first terminals being inserted into the first terminal grooves of the insulating housing through the inserting space of the insulating housing and the second contact portions of the second terminals being inserted into the second terminal grooves of the insulating housing through the inserting space of the insulating housing; the first main body of the first terminal pack has a first locating portion, and a first protruding portion protruding forward from a middle of a front of the first locating portion, the second main body of the second terminal pack has a step-shaped second locating portion, and a second protruding portion protruding forward from a middle of a front of a lower step of the second locating portion, a bottom of the first protruding portion of the first main body is positioned on a top face of the second protruding portion of the second main body, and a bottom of the first locating portion of the first main body is partially positioned on a top face of the lower step of the second locating portion of the second main body with a rear of the first locating portion of the first main body abutting against a front of an upper step of the second locating portion of the second main body; two portions of a rear of a top surface of the top wall of the insulating housing protrude upward to form two restricting blocks, two rears of two opposite sides of a bottom surface of the bottom wall of the insulating housing are recessed inward to form two buckling grooves, the shielding shell has a top plate of which two opposite sides of a rear edge are recessed inward to form two restricting grooves for restricting the restricting blocks therein, a bottom plate of which two opposite sides of a rear are punched inward to form two buckling pieces buckled in the buckling grooves, and two lateral plates of which two bottoms of two rears extend rearward and then extend upward to form two clamping pieces, two tops of the two clamping pieces bend face to face for pressing on two opposite sides of a rear of the first protruding portion of the first terminal pack.

* * * * *